US008807062B2

(12) United States Patent
Tahar et al.

(10) Patent No.: US 8,807,062 B2
(45) Date of Patent: Aug. 19, 2014

(54) UNCONDITIONALLY STABLE FLOATING OFFSHORE PLATFORM

(75) Inventors: Arcandra Tahar, Houston, TX (US); Edward E. Horton, III, Houston, TX (US); James V. Maher, Houston, TX (US)

(73) Assignee: Horton Wison Deepwater, Inc., Houston, TX (US)

( * ) Notice: Subject to any disclaimer, the term of this patent is extended or adjusted under 35 U.S.C. 154(b) by 417 days.

(21) Appl. No.: 13/087,970

(22) Filed: Apr. 15, 2011

(65) Prior Publication Data

US 2011/0253023 A1 Oct. 20, 2011

Related U.S. Application Data

(60) Provisional application No. 61/324,514, filed on Apr. 15, 2010.

(51) Int. Cl.
*B63B 35/44* (2006.01)
*B63B 43/06* (2006.01)

(52) U.S. Cl.
USPC ..... 114/265; 114/264; 114/125; 405/195.1

(58) Field of Classification Search
USPC ..... 114/121, 125, 264–266; 405/195.1–208, 223.1–224.4
See application file for complete search history.

(56) References Cited

U.S. PATENT DOCUMENTS 3,949,693 A 4/1976 Bauer et al.
4,516,882 A * 5/1985 Brewer et al. ..... 405/224
4,864,958 A 9/1989 Bekinsky
6,244,786 B1 6/2001 Johansson
6,935,810 B2 * 8/2005 Horton, III ..... 405/200
7,011,472 B2 * 3/2006 Martensson et al. ..... 405/205
7,281,483 B1 10/2007 Horton, III et al.
7,462,000 B2 * 12/2008 Leverette et al. ..... 405/223.1

(Continued)

FOREIGN PATENT DOCUMENTS

NO 314133 B1 2/2003
WO WO 8602328 A * 4/1986 ..... B63B 9/08

(Continued)

OTHER PUBLICATIONS

International Application No. PCT/US2011/032726 Search Report and Written Opinion dated Sep. 29, 2011.

(Continued)

*Primary Examiner* — Ajay Vasudeva
(74) *Attorney, Agent, or Firm* — Conley Rose, P.C.

(57) ABSTRACT

A platform for offshore drilling and/or production operations comprises an equipment deck. In addition, the platform comprises a buoyant hull coupled to the equipment deck and configured to extend below the surface of the water. The hull comprises a first column having a central axis, an upper end coupled to the deck, a lower end distal the deck, and a plurality of axially stacked cells between the upper end and the lower end. Each cell defining an inner chamber within the cell and an exterior region outside the cell. The plurality of cells includes a first cell extending from the upper end of the first sub-column and a second cell axially positioned below the first cell. The first cell is water-tight. Further, the second cell includes a gas port configured to supply a buoyancy control gas to the inner chamber of the second cell.

7 Claims, 11 Drawing Sheets

(56) References Cited

U.S. PATENT DOCUMENTS

| | | | | |
|---|---|---|---|---|
| 7,891,909 | B2 * | 2/2011 | Tahar et al. | 405/195.1 |
| 8,087,849 | B2 * | 1/2012 | Leverette et al. | 405/223.1 |
| 8,220,407 | B2 * | 7/2012 | Williams et al. | 114/265 |

FOREIGN PATENT DOCUMENTS

| | | | |
|---|---|---|---|
| WO | 2004/110855 | A2 | 12/2004 |
| WO | 2004110855 | A2 | 12/2004 |
| WO | 2005072221 | A2 | 8/2005 |

OTHER PUBLICATIONS

Chinese Office Action dated Apr. 28, 2014; Chinese Application No. 201180019298.5 (11 p.).

English Summary of Chinese Office Action dated May 20, 2014; Chinese Application No. 201180019298.5 (3 p.).

* cited by examiner

UNCONDITIONALLY STABLE FLOATING OFFSHORE PLATFORM

CROSS-REFERENCE TO RELATED APPLICATIONS

This application claims benefit of U.S. provisional patent application Ser. No. 61/324,514 filed Apr. 15, 2010, and entitled "Multi Column Tension Leg Platform," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to floating offshore structures. More particularly, the invention relates to unconditionally stable buoyant semi-submersible platforms and tension leg platforms for offshore drilling and production.

2. Background of the Technology

Conventional semi-submersible offshore platforms and tension leg platforms include a hull that has sufficient buoyancy to support a work platform above the water surface, as well as rigid and/or flexible piping or risers extending from the work platform to the seafloor, where one or more drilling or well sites are located. Whether a semi-submersible or tension leg platform, the hull typically includes a plurality of horizontal pontoons that support a plurality of vertically upstanding columns, which in turn support the work platform above the surface of the water. For example, in FIG. 1A, a conventional offshore platform 10 for the drilling and/or production of hydrocarbons includes a hull 20 that supports a work platform 30 above the sea surface 11. Hull 20 is formed from a plurality of generally horizontal pontoons 21 extending between a plurality of generally vertical columns 22. In general, the size of the pontoons and the number of columns are governed by the size and weight of the work platform and associated payload to be supported. For tension leg platforms, the columns primarily function to provide buoyancy, while the tendons provide stability (e.g., resist excessive tilting/listing of the platform). For semi-submersible offshore structures, the pontoons function as the primary source of buoyancy, while the columns (and associated spacing) provide stability. For most semi-submersible and tension leg platform, each column typically includes an opening at its upper end above the sea surface. Such openings may include access trunks allowing personnel access entry into the column; hawse pipes permitting chain to be pulled into and stores in chain lockers within the columns; ventilation pipes and ducts; or combinations thereof. These openings may permit seawater to flood the column either from a wave washing over the top of the column or from seawater entering the column due to excessive vessel heel.

Wind and wave excitation forces at and below the sea surface continuously seek to move offshore structures. Translational movement of semi-submersible platforms at the sea surface is typically limited by mooring lines extending from the platform to the sea floor, and translational movement of tension leg platforms at the sea surface is typically limited by tendons that extend from the platform to the sea floor and are placed in tension. Mooring lines allow for some vertical movement of the semi-submersible structures (e.g., heave) relative to the sea floor, while tendons restrict and/or prevent vertical movement of tension leg platforms relative to the sea floor. Wind and wave excitation forces may also cause offshore structures (e.g., semi-submersible or tension leg platforms) to tilt or list to one side. For example, in FIG. 1B, offshore platform 10 is shown tilting or listing to one side due to wind and wave forces acting on platform 10. The angle through which the offshore structure tilts relative to vertical, neutral is often referred to as the "heeling" angle, and is designated as angle $\alpha$ in FIG. 1B. If the heeling angle is sufficiently large, the offshore structure may capsize with potentially catastrophic effects.

For semi-submersible platforms, the geometry and arrangement of the columns operate to resist excessive heeling and restore the platform back to its upright, neutral position. However, with extreme wind and/or wave excitation forces, heeling angles can be quite large. At a sufficiently large heeling angle sea water is allowed to flow directly from the sea into one or more openings in the top of the columns of the platform. The smallest heeling angle at which the opening in the upper end of one or more columns is positioned at the sea surface is often referred to as the "downflooding" angle, and is designated as angle $\beta$ in FIG. 1C. When the heeling angle is equal to or greater than the downflooding angle, the uncontrolled flooding of one or more columns further exacerbates listing, and may cause the platform to capsize. For tension leg platforms, the tendons operate to resist excessive heeling and restore the platform back to its upright, neutral position. However, in some cases, one or more tendons may fail, potentially allowing the platform to tilt to the downflooding angle.

Accordingly, there remains a need in the art for offshore platforms that are unconditionally stable and able to resist capsizing. Such offshore platforms would be particularly well-received if they were unconditionally stable, regardless of the geometry and arrangement of the columns and integrity of tendons.

BRIEF SUMMARY OF THE DISCLOSURE

These and other needs in the art are addressed in one embodiment by a platform for offshore drilling and/or production operations. In an embodiment, the platform comprises an equipment deck configured to be disposed above the surface of the water. In addition, the platform comprises a buoyant hull coupled to the equipment deck and configured to extend below the surface of the water. The hull comprises a first column having a central axis, an upper end coupled to the deck, a lower end distal the deck, and a plurality of axially stacked cells between the upper end and the lower end, each cell defining an inner chamber within the cell and an exterior region outside the cell. The plurality of cells includes a first cell extending from the upper end of the first sub-column and a second cell axially positioned below the first cell. The first cell is water-tight. The second cell includes a gas port configured to supply a buoyancy control gas to the inner chamber of the second cell.

These and other needs in the art are addressed in another embodiment by a platform for offshore drilling and/or production operations. In an embodiment, the platform comprises an equipment deck configured to be disposed above the surface of the water. In addition, the platform comprises a buoyant hull coupled to the equipment deck and configured to extend below the surface of the water. The hull comprises a first column and a second column, each column having an upper end coupled to the deck and a lower end distal the deck. The hull also comprises a first elongate pontoon extending between the first column and the second column. The first column comprises a plurality of elongate parallel sub-columns including a first sub-column having a central axis, an upper end at the upper end of the first column, a lower end at the lower end of the first column, and a plurality of vertically stacked cells between the upper end and the lower end, each cell defining an inner chamber within the cell and an exterior region outside the cell. The plurality of cells includes a first cell extending axially from the upper end of the first sub-column and a second cell axially positioned between the first cell and the lower end of the first sub-column. The second cell includes a gas port configured to supply a buoyancy control gas to the inner chamber of the second cell. Moreover, the hull comprises a port configured to allow the water to freely pass into and out of the inner chamber of the second cell.

These and other needs in the art are addressed in another embodiment by a platform for offshore drilling and/or production operations. In an embodiment, the platform comprise an equipment deck configured to be disposed above the surface of the water. In addition, the platform comprises a buoyant hull coupled to the equipment deck and configured to extend below the surface of the water. The buoyant hull is configured to generate a decreasing value of a righting moment followed by an increasing value of the righting moment.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1C:
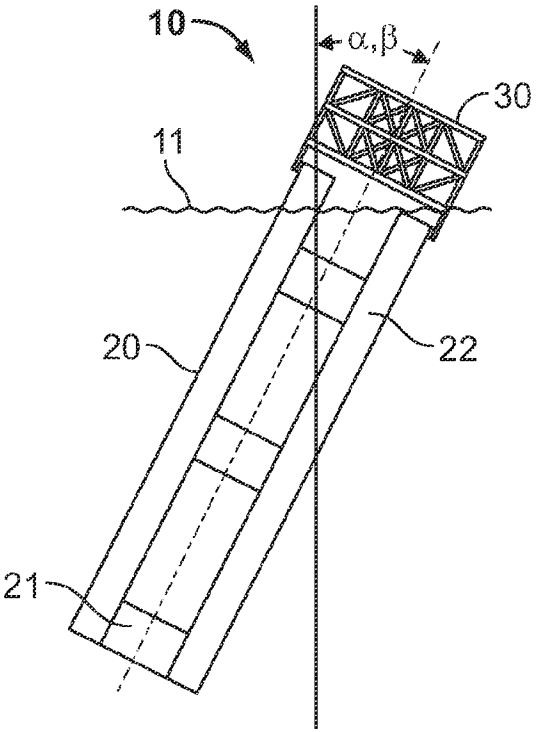
FIG. 1c (Prior Art)
FIG. 1C is a schematic view of the offshore platform of FIG. 1A in a potentially unstable position in which the heeling angle of the platform is equal to or greater than the downflooding angle of the platform.
Figure 1B:
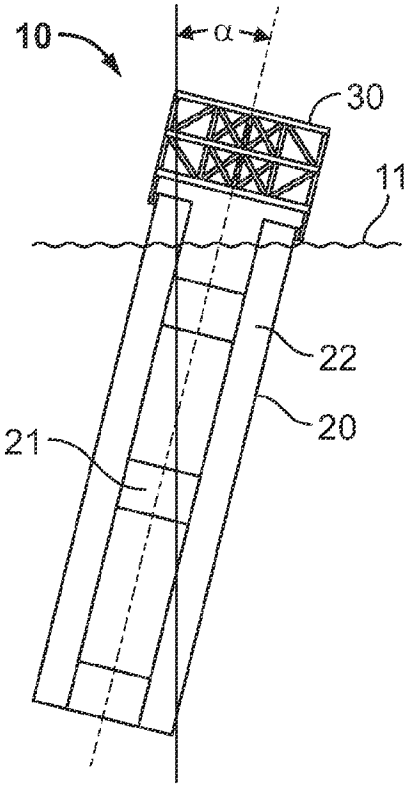
FIG. 1B (Prior Art)
FIG. 1B is a schematic view of the offshore platform of FIG. 1A in a stable position listing to one side.
Figure 1A:
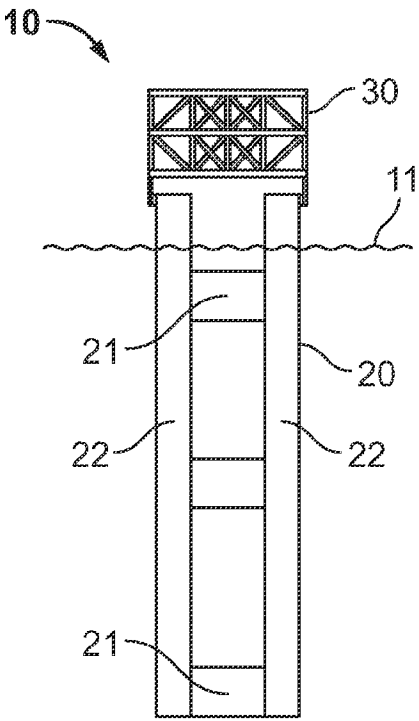
FIG. 1A (Prior Art)
FIG. 1A is a schematic view of a conventional offshore platform in a stable, vertical orientation.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 2:
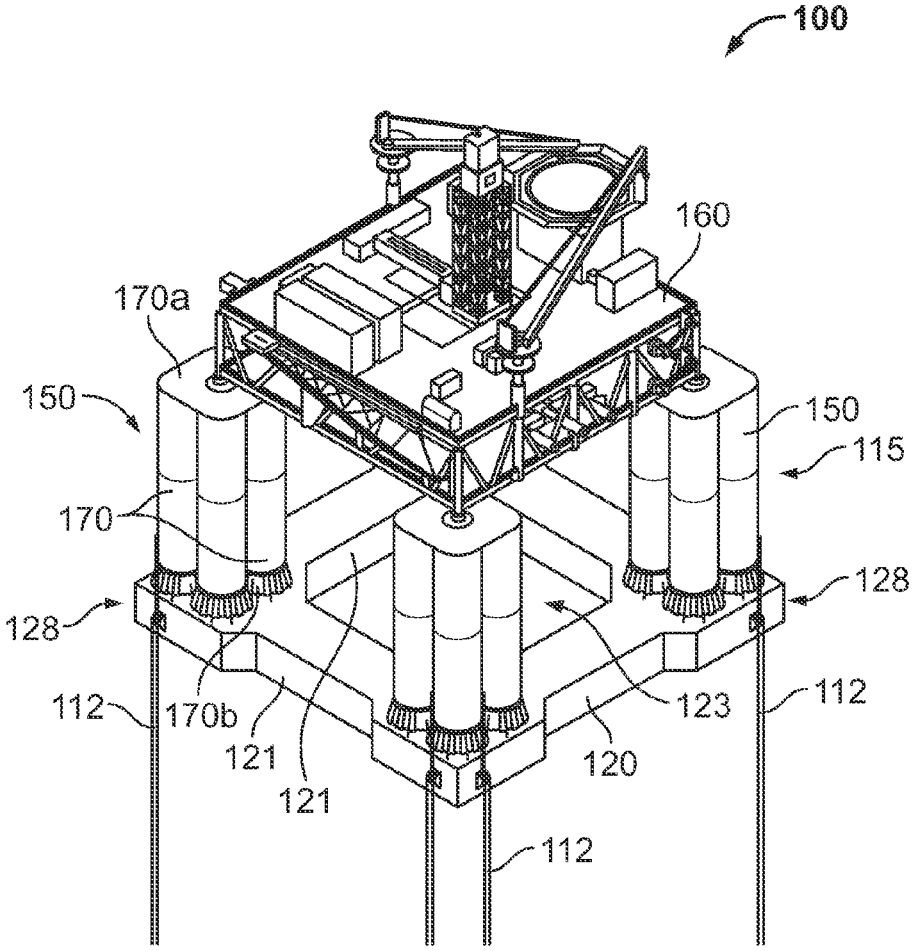
FIG. 2 is an embodiment of an unconditionally stable multicolumn floating offshore tension leg platform in accordance with the principles described herein.
Figure 3:
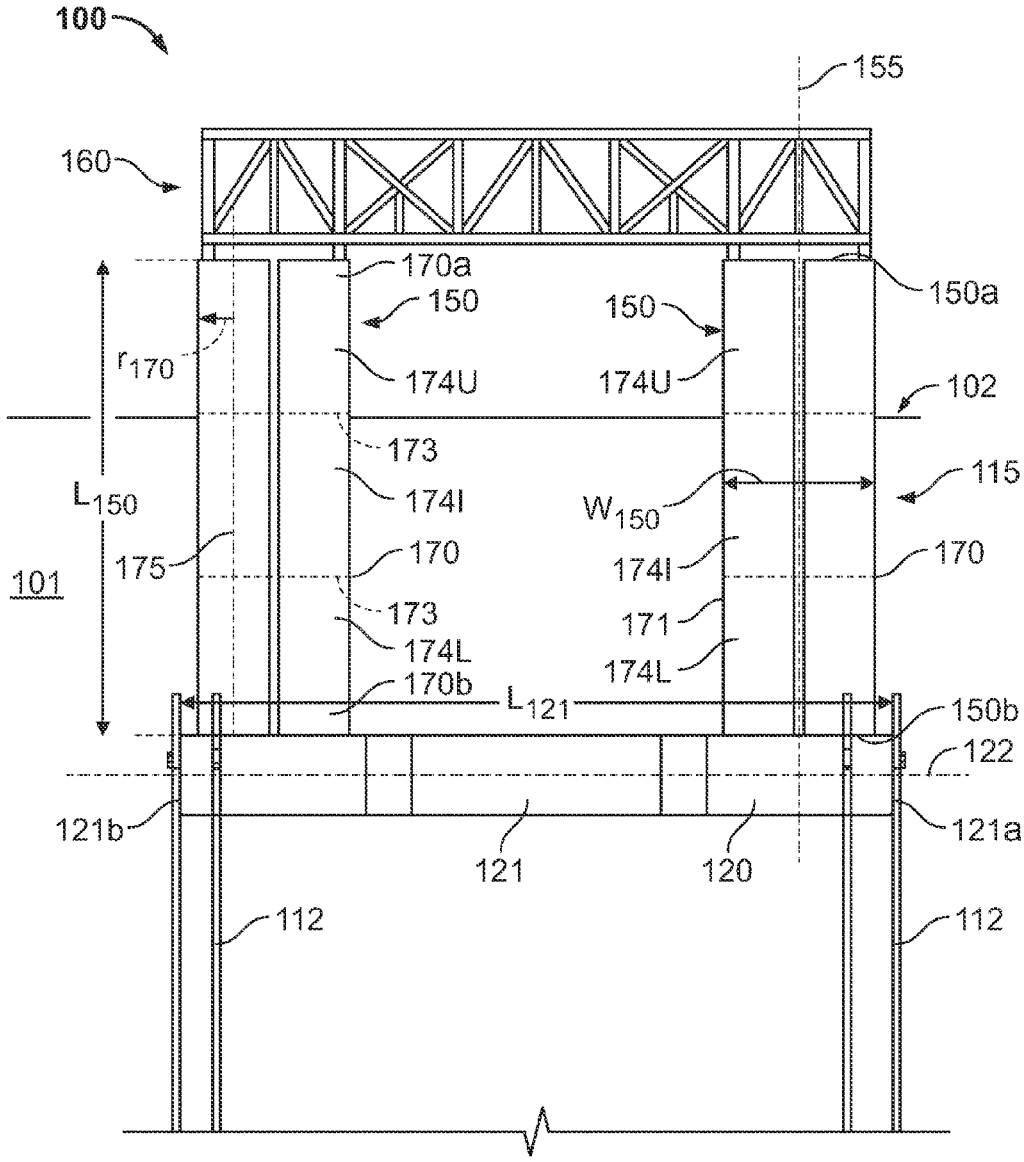
FIG. 3 is a side view of the hull of FIG. 2.

Referring now to FIGS. 2 and 3, an embodiment of a multicolumn floating offshore tension leg platform 100 in accordance with the principles described herein is illustrated. Platform 100 is shown deployed in a body of water 101 in an operational configuration and anchored over an operation site with a plurality of tendons 112, each tendon extending from platform 100 to the sea floor. Offshore platform 100 comprises a floating hull 115 having an adjustably buoyant horizontal base 120 disposed below the surface 102 of water 101 and a plurality of adjustably buoyant columns 150 extending vertically from base 120 through the surface 102. Tendons 112 are sized and designed to be placed in tension between the sea floor and platform 100. Thus, the buoyancy of base 120 and columns 150 are adjusted such that hull 115 is net buoyant, thereby ensuring tendons 112 are in tension. A work platform or equipment deck 160 is mounted to hull 115 atop columns 150 when platform 100 is operationally deployed. Platform 100 may be transported as a single unit to the operational site (e.g., deck 160 may be mounted atop hull 115 at a shipyard or near shore prior to moving platform 100 to the operational site), or platform 100 may be completed at the operational site (e.g., deck 160 may be mounted atop hull 115 at the offshore operational site). The various equipment typically used in drilling and/or production operations, such as a derrick, draw works, pumps, scrubbers, precipitators and the like are disposed on and supported by equipment deck 160.

Referring now to FIGS. 2-5, base 120 of hull 115 comprises a plurality of straight, elongated pontoons 121 connected end-to-end to form a closed loop base 120 with a central opening 123 through which risers may pass up to the equipment deck 160. In this embodiment, four equal-length pontoons 121 are connected end-to-end to form a generally square base 120 having four corners 128 formed at the intersection of each pair of pontoons 121. In this embodiment, two tendons 112 extend from each corner 128 to the sea floor. Each pontoon 121 extends between two columns 150 and includes ballast tanks that can be selectively filled with ballast water to adjust the buoyancy of base 120.

Figure 4:
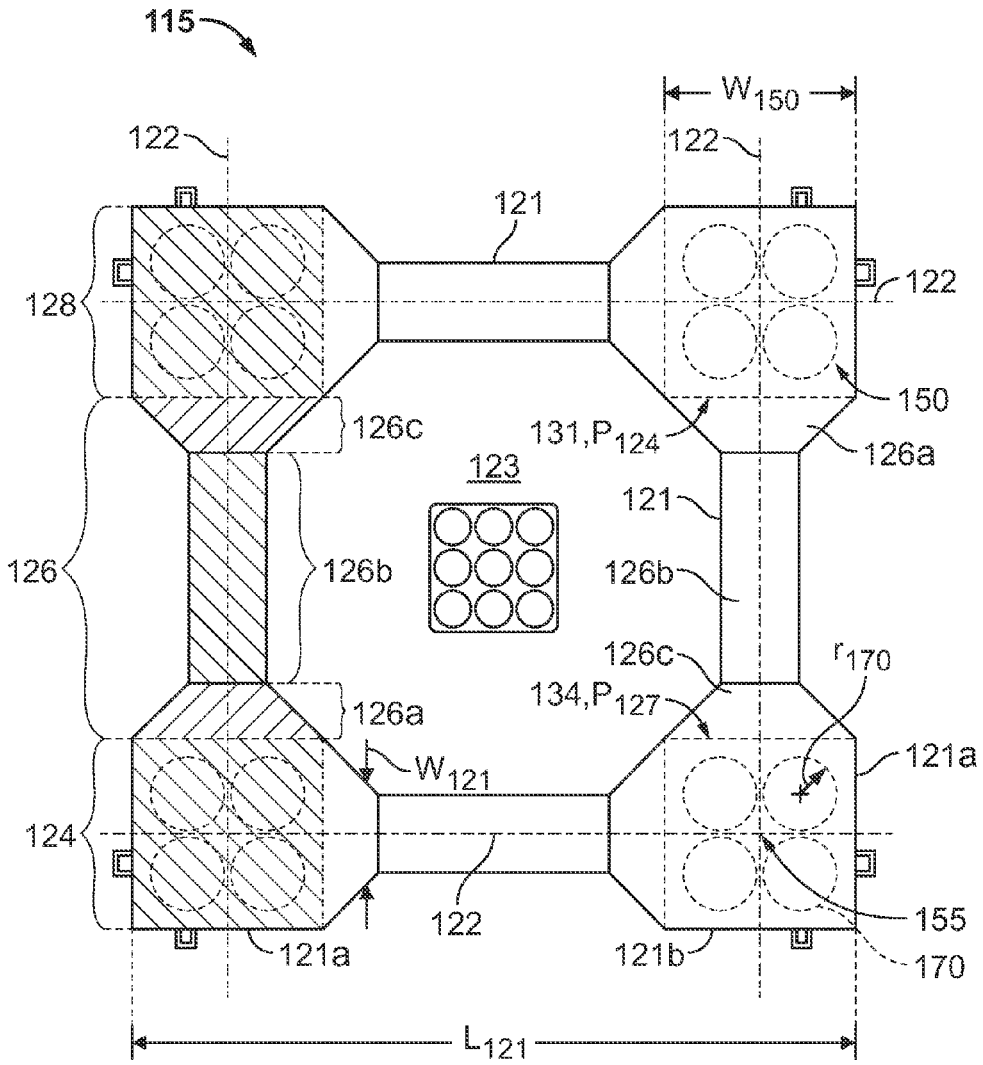
FIG. 4 is a bottom plan view of the hull of FIG. 2.
Figure 5:
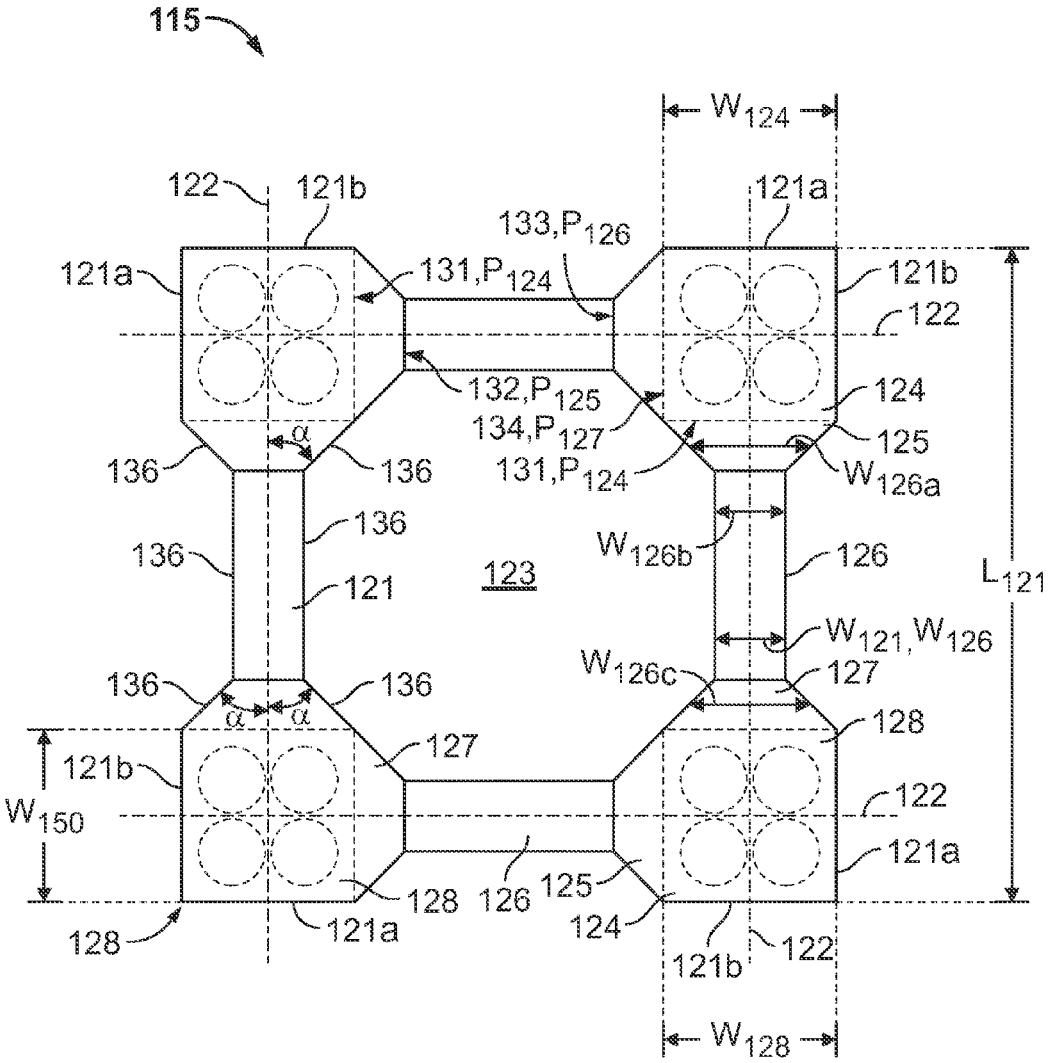
FIG. 5 is a schematic bottom view of the hull of FIG. 2.
Figure 6:
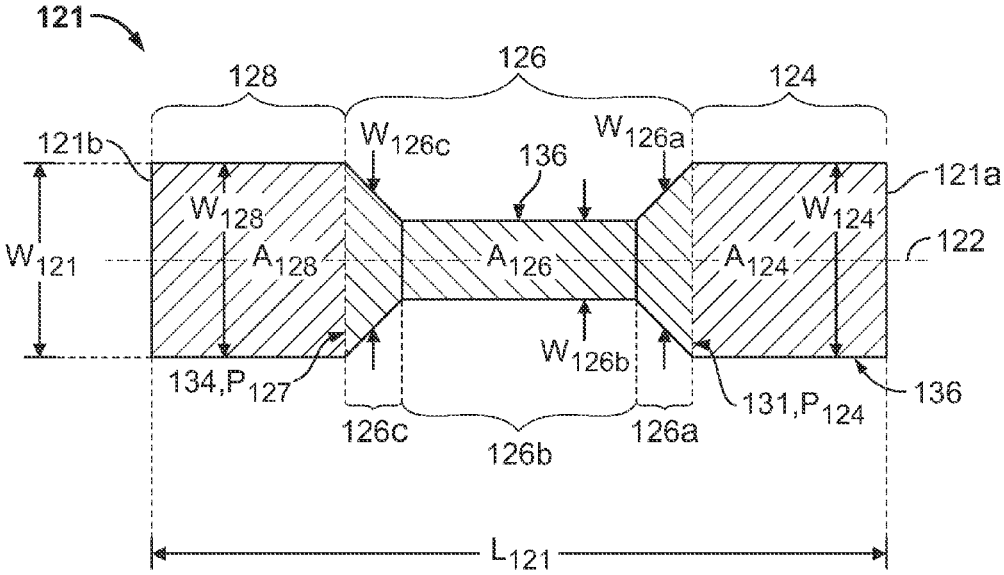
FIG. 6 is a schematic bottom view of one of the pontoons of the hull of FIG. 2.

Referring now to FIGS. 4-6, each pontoon 121 supports two columns 150 and extends linearly along a central or longitudinal axis 122 between a first end 121*a* and a second end 121*b*. In this embodiment, each pontoon 121 is symmetric about its axis 122 in bottom view. Each pontoon 121 has a length $L_{121}$ measured parallel to axis 122 between its ends 121*a, b*. In this embodiment, length $L_{121}$ of each pontoon 121 is the same, however, in other embodiments, the length of one or more pontoons (e.g., length $L_{121}$ of one or more pontoons 121) may be different.

As previously described, the four straight, elongated pontoons 121 are connected end-to-end to form a closed loop hull 115. In particular, each end 121*a, b* of each pontoon 121 intersects with one end 121*a, b* of another pontoon 121 to form corners 128. For example, as best shown in FIGS. 4 and 5, moving clockwise around base 120, second end 121*b* of a first pontoon 121 intersects first end 121*a* of a second pontoon 121, and second end 121*b* of second pontoon 121 intersects first end 121*a* of a third pontoon 121, and second end 121*b* of third pontoon 121 intersects first end 121*a* of the fourth pontoon 121. In this embodiment, each pontoon 121 has a rectangular cross-section taken perpendicular to its longitudinal axis 122. However, in general, the pontoons (e.g., pontoons 121) may have any suitable cross-sectional geometry including, without limitation, circular, oval, triangular, etc.

Referring still to FIGS. 4-6, each pontoon 121 includes a first section or node 124 at end 121*a* that underlies and supports one column 150, a second section or node 128 at the opposite end 121*b* that underlies and supports another column 150, and an intermediate section 126 extending axially between nodes 124, 128. First node 124 extends axially from first end 121*a* to intermediate section 126 and a bulkhead 131 generally coincident with a vertical plane $P_{124}$ perpendicular to axis 122, and second node 128 extends axially from second end 121*b* to intermediate section 126 and a bulkhead 134 generally coincident with a vertical plane $P_{127}$ perpendicular to axis 122. Due to the intersection of two pontoons 121 at each corner 128 and each node 124, 128, it should be appreciated that first node 124 of one pontoon 121 is coincident with (and overlaps) second node 128 of a different pontoon 121 in bottom view. Intermediate section 126 is the only portions of each pontoon 121 that does not intersect or overlap with another pontoon 121 in bottom view (FIGS. 4 and 5).

The lower surface of each node 124 has a surface area $A_{124}$, the lower surface of each node 128 has a surface area $A_{128}$, the lower surface of each intermediate section 126 has a surface area $A_{126}$. It should be appreciated that each node 124 is coincident with one node 128, and thus, the lower surface area $A_{124}$ of each node 124 is the same as the lower surface area $A_{128}$ of each node 128. Further, in this embodiment, lower surface area $A_{124}$, $A_{128}$ of each node 124, 128 is the same, and lower surface area $A_{126}$ of each intermediate section 126 is the same.

Each pontoon 121 has a width $W_{121}$ measured perpendicularly to its axis 122 in bottom view. Unlike conventional pontoons that typically have a constant or uniform width along their entire length, in this embodiment, width $W_{121}$ of each pontoon 121 varies along its length $L_{121}$-first node 124 has a constant or uniform width $W_{124}$ and second node 128 has a constant or uniform width $W_{128}$, however, in intermediate section 126, width $W_{121}$ varies. In particular, each intermediate section 126 may be divided into a first transition portion 126*a* having a width $W_{126a}$, a second transition portion 126*c* having a width $W_{126c}$, and a middle portion 126*b* extending axially between transition portions 126*a, b* and having a width $W_{126b}$. Width $W_{126a}$ decreases in first transition portion 126*a* moving axially from first node 124 to middle portion 126*b*, width $W_{126c}$ decreases in second transition portion 126*c* moving axially from first node 124 to middle portion 126*b*, and width $W_{126b}$ is constant or uniform in middle portion 126*b*. In this embodiment, width $W_{124}$ and width $W_{128}$ are the same, however, width $W_{126b}$ is less than both width $W_{124}$ and width $W_{128}$. Further, width $W_{126a}$, $W_{126c}$ transitions from width $W_{124}$, $W_{128}$, respectively, to width $W_{126b}$. Thus, width $W_{121}$ of each pontoon 121 is a maximum in nodes 124, 128 (i.e., width $W_{124}$ and width $W_{128}$ each represent the maximum width of each pontoon 121), and a minimum in middle portion 126*b* of intermediate section 126 (i.e., width $W_{126b}$ represents the minimum width of each pontoon 121). Accordingly, each pontoon 121 may generally be described as having a "dog bone" shape in bottom view.

As best shown in FIGS. 5 and 6, each pontoon 121 has a pair of lateral sidewalls 136 on either side of its axis 122 in bottom view. In transition portions 126*a, c*, lateral sidewalls 136 converge toward each other in bottom view as they extend toward intermediate section 126, and in intermediate section 126, lateral sidewalls 136 extend generally parallel to axis 122 in bottom view. Specifically, in transition portions 126*a, c*, each sidewall 136 are oriented at an acute angle $\alpha$ relative to axis 122 in bottom view. Angle $\alpha$ is preferably between 30° and 60°. In this embodiment of platform 100, each sidewall 136 is oriented at an angle $\alpha$ of about 45° within transition portions 126*a, c*.

Without being limited by this or any particular theory, the heave characteristics of an offshore floating structure (e.g., platform 100) are influenced by the draft of the structure and the geometry of the structure. Regarding geometry, a critical factor affecting heave is the shape of the lower pontoons (e.g., pontoons 121), and in particular, the shape of the lower surface of the pontoons, which are subject to the vertical forces imposed by waves. The shape of the lower surface of a pontoon may be characterized by a "pontoon lower surface area ratio" defined as the ratio of the lower surface area of the pontoon excluding the nodes to the total lower surface area of the nodes of the pontoon as follows:

$$\text{Pontoon Lower Surface Area Ratio} = \frac{SA_{remainder}}{SA_{nodes}} = \frac{(SA_{pontoon} - SA_{nodes})}{SA_{nodes}},$$

where: $SA_{nodes}$ is the sum of the lower surface areas of the nodes of the pontoon;

$SA_{remainder}$ is the lower surface area of the pontoon excluding the lower surface areas of the nodes of the pontoon; and $SA_{pontoon}$ is the lower surface area of the entire pontoon.

In the embodiment of platform 100 previously described, the sum of the lower surface areas of nodes 124, 128 of one pontoon is lower surface area $A_{124}$ plus lower surface area $A_{128}$, and the total lower surface area of the remainder of each pontoon 121 is lower surface area $A_{126}$. Thus, the pontoon lower surface area ratio for platform 100 previously described is:

$$\frac{A_{126}}{(A_{124}+A_{128})}.$$

In general, the lower the pontoon lower surface area ratio, the lower the heave. For most conventional pontoons for offshore structures, the pontoon lower surface area ratio is typically between 0.75 to 1.0. However, for embodiments of "dog bone" shaped pontoons in accordance with the principles described herein (e.g., pontoons 121), the pontoon lower surface area ratio is preferably between 0.45 and 0.6. In particular, each pontoon 121 previously described has a pontoon lower surface area ratio of about 0.54.

The shape of the lower surface of each pontoon may also be characterized by a "minimum pontoon-to-column width ratio" defined as the ratio of the minimum width of the pontoon in bottom view measured perpendicular to the pontoons central or longitudinal axis to the width of a column supported by the pontoon at the intersection of the column and the pontoon (i.e., width of column footprint) in bottom view measured perpendicular to the pontoons central or longitudinal axis as follows:

$$\text{Pontoon-to-Column Width Ratio} = \frac{\text{Minimum Pontoon Width}}{\text{Column Width}}$$

In the embodiment of platform 100 previously described, width $W_{150}$ of each column 150 is uniform along its entire length, and thus, the width of each column 150 at its intersection with pontoon 121 as measured perpendicular to axis 122 of pontoon 121 is width $W_{150}$. Further, width $W_{121}$ of each pontoon 121 is at a minimum along middle portion 126*b*, and thus, the minimum width of each pontoon 121 is width $W_{126b}$. Thus, the pontoon-to-column width ratio for "dog bone" shaped pontoon 121 previously described is:

$$\frac{W_{126b}}{W_{150}}.$$

In general, the lower the pontoon-to-column width ratio, the lower the heave. For most conventional pontoons for offshore structures, the pontoon-to-column width ratio is typically between 1.15 and 1.25. However, for embodiments of pontoon 121 of platform 100, the pontoon-to-column width ratio is preferably less than 1.0, and more preferably between 0.65 and 0.75. In particular, each pontoon 121 previously described has a pontoon-to-column width ratio of about 0.7.

As compared to pontoons employed in conventional semi-submersible offshore structures (e.g., pontoons 21 employed in platform 10), embodiments described herein including "dog bone" shaped pontoons (e.g., platform 100 including pontoons 121) offer the potential for a hull with reduced weight and reduced material requirements. Further, without being limited by this or any particular theory, by reducing the vertical area or surface area of the lower surface of the hull, it is believed that embodiments described herein offer the potential for reduced heave as compared to conventional offshore platforms, particularly in shallower draft applications (e.g., ~120 foot draft applications). By reducing draft without a substantial increase in heave as compared to a conventional design, embodiments described herein also offer the potential to increase the ease of quayside topside integration.

Without being limited by this or any particular theory, the preferred ranges for the pontoon lower surface area ratio and the pontoon-to-column width ratio offer the potential for a pontoon that experiences reduced heave, while providing sufficient strength and rigidity. For example, if the pontoon lower surface area ratio gets sufficiently small, implying the lower surface area of the pontoon outside the nodes is relatively small, the pontoon may not have sufficient strength and rigidity when subjected to subsea loads and torques. Likewise, if the pontoon-to-column width ratio gets sufficiently small, implying the minimum width of the pontoon is relatively small, the pontoon may not have sufficient strength and rigidity when subjected to subsea loads and torques.

Referring again to FIGS. 2-4, each column 150 of the hull 115 extends linearly along a straight central or longitudinal axis 155 between a first or upper end 150*a* and a second or lower end 150*b*. Axis 155 of each column 150 is perpendicular to axis 122 of each pontoon 121. Deck 160 is attached to upper end 150*a* of each column 150, and base 120 is attached to lower end 150*b* of each column 150 at the intersection of two pontoons 121. In particular, lower end 150*b* of each column 150 sits atop one node 124, 128 of each pontoon 121. Each column 150 has a width $W_{150}$ measured perpendicular to axis 155 in side view (FIG. 3) and perpendicular to axis 122 of one of the pontoons 121 upon which it is attached in bottom view (FIG. 4). In this embodiment, width $W_{150}$ of each column 150 is the same, and is uniform along its entire length.

In this embodiment, each column 150 is a "multi-column" comprising a plurality of parallel, elongated sub-columns 170, each sub-column 170 extending from end 150*a* at deck 160 to end 150*b* at base 120. Each elongated, vertical sub-column 170 is oriented parallel to axis 155 and has a radius $r_{170}$. Further, in this embodiment, each sub-column 170 is equidistant from axis 155 of its respective column 150. In this embodiment, each column 150 is made from four sub-columns 170 equally spaced from axis 155, thereby defining generally square columns 150 with widths $W_{150}$ equal to about four times sub-column radius $r_{170}$. The gap in the middle of the four sub-columns 170 defining each column 150 provides a space for storing mooring ropes and/or chains.

Figure 7:
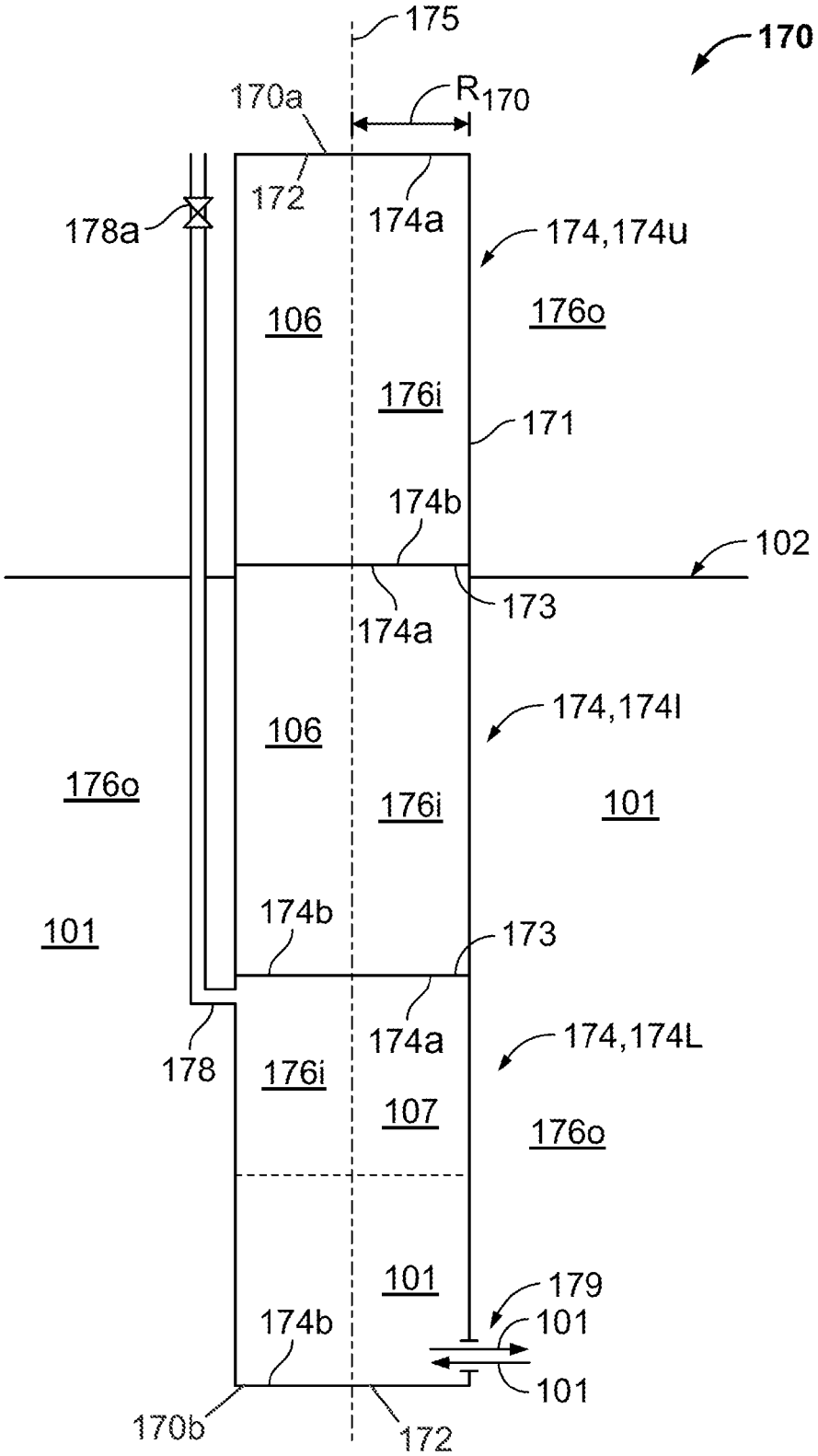
FIG. 7 is a schematic side view of one of the columns of the hull of FIG. 2.

Referring now to FIG. 7, one sub-column 170 is schematically shown, it being understood that each sub-column 170 of hull 115 is configured the same. Sub-column 170 has a central axis 175, a closed upper end 170*a* coincident with end 150*a* of its corresponding column 150, and a closed lower end 170*b* coincident with end 150*b* of its corresponding column 150. In this embodiment, sub-column 170 comprises a radially outer tubular 171 extending between ends 170*a, b*, upper and lower end walls or caps 172 at ends 170*a, b*, respectively, and a plurality of axially spaced bulkheads 173 positioned within tubular 171 between ends 170*a, b*. End walls 172 and bulkheads 173 are each oriented perpendicular to axis 175. Together, tubular 171, end walls 172, and bulkheads 173 define a plurality of vertically stacked compartments or cells 174 within sub-column 170. End caps 172 close off ends 170*a, b* of sub-column 170, thereby restricting and/or preventing fluid flow through ends 170*a, b* into cells 174.

In this embodiment, sub-column 170 includes three cells 174—an upper cell 174 extending axially from upper end 170*a*, a lower cell 174 extending axially from lower end 170*b*, and an intermediate cell 174 extending axially between the upper and lower cells 174. For purposes of clarity and further explanation, upper cell 174 is also designated as 174U, intermediate cell is also designated as 174I, and lower cell is also designated as 174L. As best shown in FIG. 3, when platform 100 is deployed for offshore operations, each upper cell 174U extends through or is disposed above the surface 102 of water 101, each intermediate cell 1711 is at least partially disposed below the surface 102 of water 101, and each lower cell 174L is disposed below the sea surface 102 (i.e., completely submerged in water 101). Although each sub-column 170 includes three cells 174 in this embodiment, in general, each sub-column (e.g., each sub-column 170) may include any suitable number of cells (e.g., two, four, five, etc.).

Each cell 174 has an upper end 174*a*, a lower end 174*b* opposite upper end 174*a*, and defines an inner region or chamber 176*i* within the cell 174 and an outer or exterior region 176*o* outside the cell 174. In this embodiment, each cell 174 axially above lower cell 174L (i.e., upper cell 174U and intermediate cell 174I) is sealed and water-tight. Consequently, chamber 176*i* of upper cell 174U is isolated and sealed off from exterior region 176*o* and the chambers 176*i* of each adjacent cell 174 (e.g., chamber 176*i* of intermediate cell 174I), and chamber 176*i* of intermediate cell 174I is isolated and sealed off from exterior region 176*o* and the chambers 176*i* of each adjacent cell 174 (e.g., chambers 176*i* of upper cell 174U and lower cell 174L). Specifically, upper end cap 172, bulkhead 173, the portion of tubular 171 defining upper cell 174U, and the connections therebetween are water-tight, each being completely free of holes and ports; and bulkheads 173, the portion of tubular 171 defining intermediate cell 174I, and the connections therebetween are water-tight, each being completely free of holes and ports. In other words, chambers 176*i* of cells 174U, 174I are not in fluid communication with the surrounding environment, each other, or any other chambers 176*i*. Thus, as used herein, the terms "sealed" and "water-tight" are used to describe a chamber or cell that is completely closed off and not in fluid communication with the surrounding environment, any adjacent chambers or cells, or any inlet or outlet conduits (e.g., ventilation pipes, etc.) during offshore operations. A chamber or cell may have an access panel that allows periodic access to the inside of the chamber or shell for inspection and/or maintenance, yet still be "sealed" and "water-tight" during offshore operations by closing such access panel. Contrary to conventional offshore platform columns that include openings at their upper ends (e.g., platform 10), embodiments of sub-columns 170 described herein do not include any openings (e.g., access trunks, hawse pipe, ventilation pipes, etc.) in their upper ends 170*a*.

In this embodiment, each chamber 176*i* disposed axially above the lowermost cell 174 (i.e., lower cell 174L) is completely filled with a gas 106, which contributes to the net buoyancy of sub-column 170, its corresponding column 150, and hull 115. Thus, chambers 176*i* of upper cell 174U and intermediate cell 174I are filled with gas 106. In general, gas 106 may comprise any suitable gas or gas mixture, but preferably comprises an inert, relatively low cost gas such as air. Since chambers 176*i* of upper cell 174U and intermediate cell 174I are sealed during offshore operations, the volume of gas 106 within each cell 174U, 174I is constant during offshore operations. Although each chamber 176*i* above lower cell 174L is completely filled with gas 106 in this embodiment, in other embodiments, solid ballast, liquid ballast (e.g., sea water), or combinations thereof may be included in one or more of the chambers (e.g., chambers 176*i*) disposed above the lowermost cell to achieve the desired buoyancy of sub-column (e.g., sub-column 170).

Referring still to FIG. 7, unlike upper and intermediate cells 174U, 174I previously described, lower cell 174L is not isolated from the surrounding environment, sealed, or water-tight. Specifically, lower cell 174L includes a buoyancy control gas port 178 and a water port 179, each in fluid communication with internal chamber 176*i*. In this embodiment, port 178 is disposed proximal upper end 174*a*, while water port 179 is disposed proximal lower end 174*b*. Further, in this embodiment, each port 178, 179 extends radially through the portion of outer tubular 171 defining lower cell 174L. However, in general, the gas port (e.g., port 178) and the water port (e.g., port 179) may extend through other portions of the lower cell (e.g., lower cell 174L). For example, the gas port may extend through the bulkhead at the upper end of the lower cell (e.g., bullhead 173 at upper end 174*a* of lower cell 174L); and the water port may extend through the lower end cap at the lower end of the lower cell; or combinations thereof. However, the gas port is preferably disposed proximal or at the upper end of the lower cell (e.g., upper end 174*a* of lower cell 174L), and the water port is preferably disposed proximal or at the lower end of the lower cell (e.g., lower end 174*a* of lower cell 174L). Further, any passages (e.g., ports, etc.) extending through a bulkhead are preferably completely sealed and isolated from the chamber adjacent the chamber including the port (e.g., the lower chamber). For example, in embodiments where gas port 178 extends through bulkhead 173 at upper end 174*a* of lower cell 174L, port 178 is preferably isolated from and not in fluid communication with the contents (e.g., air) within chamber 176*i* of intermediate cell 174L.

Water port 179 is essentially a through hole or opening in lower cell 174L that allows fluid communication between internal chamber 176*i* of lower cell 174L and the surrounding environment. As previously described, when platform 100 is deployed for offshore operations, lower cell 174L is submerged in the water 101, and thus, port 179 allows water 101 to move into and out of internal chamber 176*i* of lower cell 174L. It should be appreciated that flow through port 179 is not controlled by a valve or other flow control device. Thus, port 179 permits the free flow of water into and out of chamber 176*i* of lower cell 174L. Although port 179 has been described as a "water" port, it should be appreciated that gas such as air is also free to flow into or out of chamber 176*i* of lower cell 174L through port 179. For example, if chamber 176*i* of cell 174L is completely filled with air, some of that air is free to flow out of chamber 176*i* via port 179.

A buoyancy control gas 107 may be controllably supplied to chamber 176*i* of lower cell 174L via port 178, and buoyancy control gas 107 within chamber 176*i* of lower cell 174L may be controllably exhausted chamber 176*i* of lower cell 174L via port 178. For example, a buoyancy control gas (e.g., compressed air) may be pumped through port 178 into chamber 176*i* of lower cell 174L, and buoyancy control gas within chamber 176*i* of lower cell 174L may be vented through port 178. Thus, port 178 functions as both a buoyancy control gas inlet and outlet. The flow of the buoyancy control gas 107 out of and into chamber 176*i* of lower cell 174L through port 178 is controlled by a valve 178*a*. Although the buoyancy control gas 107 may comprise any suitable gas, in embodiments described herein, buoyancy control gas 107 is air.

As previously described, in this embodiment, buoyancy control gas 107 can be supplied to and removed from chamber 176*i* of lower cell 174L through a single port 178. However, in other embodiments, separate ports may be used to supply gas (e.g., gas 107) to the chamber (e.g., chamber 176*i*) and vent gas from the chamber. For example, a gas inlet may be coupled to the chamber to supply gas to the chamber, and a separate and distinct gas outlet may be coupled to the chamber to vent gas from the chamber. Such an inlet and outlet each preferably comprise a valve for controlling the flow of gas therethrough.

Since buoyancy control gas 107 (e.g., air) is less dense than water 101, any buoyancy control gas 107 in chamber 176*i* of lower cell 174L will naturally rise to the upper portion of chamber 176*i* above any water 101 in chamber 176*i*. Accordingly, positioning port 178 at or proximal the upper end 174*a* of lower cell 174L allows direct access to any gas 107 therein. Since water 101 in chamber 176*i* of lower cell 174L will be disposed below any gas 107 therein, positioning port 179 proximal lower end 174*b* allows ingress and egress of water 101, while limiting and/or preventing the loss of any gas 107 through port 179. In general, gas 107 will only exit chamber 176*i* of lower cell 174L through port 179 when chamber 176*i* is filled with gas 107 from upper end 174*a* to port 179.

During deployment and operation of platform 100, the buoyancy of lower cells 174L, and hence the buoyancy of corresponding sub-columns 170 and columns 150, and hull 115 may be varied by controlling the volume of gas 107 and water 101 within chamber 176*i* of each lower cell 174L. A control system (not shown) automatically controls valve 178*a*, thereby allowing gas 107 to be pumped into or allowed to escape from chamber 176*i*, based on a variety of factors including, without limitation, the desired buoyancy of hull 115, the heeling angle of platform 100, variations in weight (e.g., top side weight, riser weight, etc.), and the desired draft of hull 115.

Without being limited by this or any particular theory, the flow of water 101 through port 179 will depend on the depth of lower cell 174L and associated hydrostatic pressure of water 101 at that depth, and the pressure of buoyancy control gas 107 in chamber 176*i* (if any). If the pressure of gas 107 is less than the pressure of water 101 in chamber 176*i* of lower cell 174L, then the gas 107 will be compressed and additional water 101 will flow into chamber 176*i* through port 179. However, if the pressure of gas 107 in chamber 176*i* of lower cell 174L is greater than the pressure of water 101 in chamber 176*i* of lower cell 174L, then the gas 107 will expand and push water 101 out of chamber 176*i* through port 179. Thus, gas 107 within chamber 176*i* of lower cell 174L will compress and expand based on any pressure differential between the air 107 and water 101 in chamber 176*i*. During deployment and operation of platform 100, gas 107 may be pumped through inlet 178 and associated valve 178*a* into chamber 176*i* to increase the pressure and volume of gas in lower cell 174L and decrease the volume of water 101 in chamber 176*i*, thereby increasing the buoyancy of corresponding sub-column 170 and column 150, and hull 115. Conversely, gas 107 may be exhausted from chamber 176*i* into the surrounding water 101 via outlet 177 and associated valve 177*a* to decrease the pressure and volume of gas 107 in chamber 176*i* and increase the volume of water 101 in chamber 176*i*, thereby decreasing buoyancy of corresponding sub-column 170, corresponding column 150, and hull 115.

As previously described, cells 174U, 174I are filled with gas 106 and sealed from the surrounding environment, however, the volume of gas 107 in lower cell 174L can be controlled and adjusted. In this embodiment, cells 174U, 174I are sized and configured such that platform 100 is net buoyant even if lower cells 174L are completely filled with water 101. Further, since cells 174U, 174I are sealed and water-tight (i.e., have no unsealed access trunks, hawse pipe for storing mooring chains, etc.), platform 100 has no downflooding angle (i.e., there is no heeling angle at which locations at sub-columns 170 will flood with water).

Figure 8:
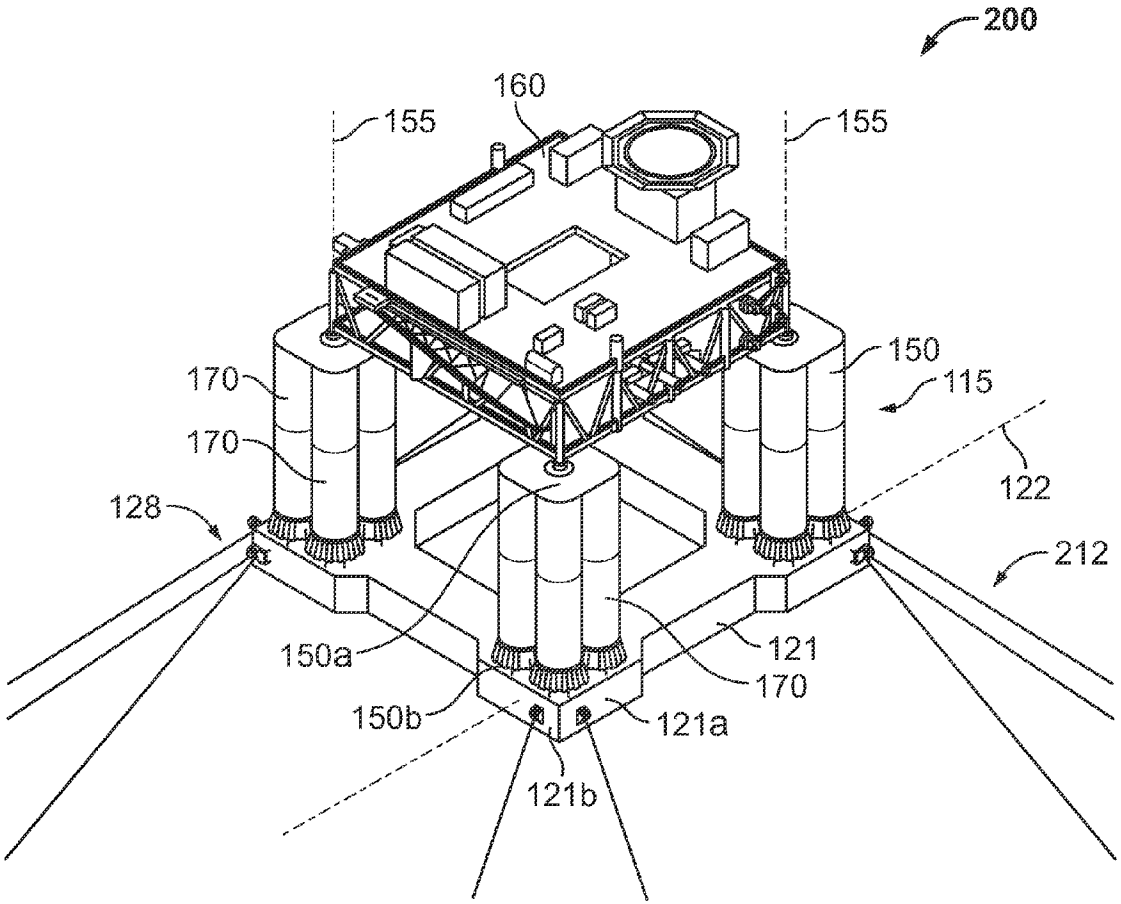
FIG. 8 is an embodiment of an unconditionally stable semi-submersible multicolumn floating offshore platform in accordance with the principles described herein.
Figure 9:
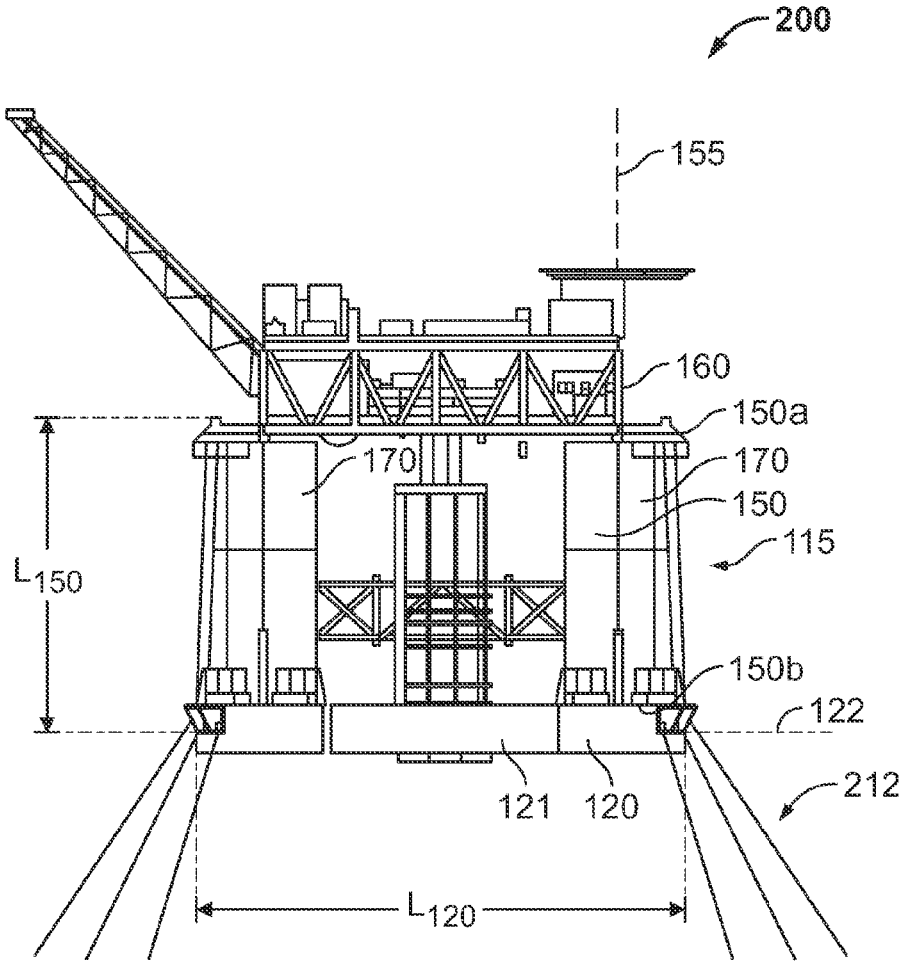
FIG. 9 is a side view of the hull of FIG. 8.

Referring now to FIGS. 8 and 9, an embodiment of a multicolumn floating offshore semi-submersible platform 200 in accordance with the principles described herein is illustrated. Platform 200 is shown deployed in a body of water 101 in an operational configuration and anchored over an operation site with a mooring system 212. In general, any suitable mooring system (e.g., taut leg, catenary mooring, etc.) may be employed to restrict the motion of platform 200. Other than the inclusion of mooring system 212 instead of tendons 112, offshore platform 200 is substantially the same as platform 100 previously described. Namely, platform 200 comprises a floating hull 115 having an adjustably buoyant horizontal base 120 and a plurality of adjustably buoyant columns 150, each as previously described. Each column 150 is a multi-column, comprising a plurality of sub-columns 170 as previously described.

Cells 174U, 174I of each sub-column 170 of semi-submersible platform 200 are filled with gas 106 (e.g., air), are sealed and water-tight, and thus, have a contain a constant volume of gas 106. However, the volume of gas 107 in each lower cell 174L can be controlled and adjusted as previously described. Similar to platform 100 described above, in this embodiment, cells 174U, 174I are sized and configured such that platform 200 is net buoyant even if lower cells 174L are completely filled with water 101. Further, since cells 174U, 174I are sealed and water-tight (i.e., have no unsealed access trunks, hawse pipe for storing mooring chains, etc.), platform 200 has no downflooding angle (i.e., there is no heeling angle at which locations at sub-columns 170 will flood with water).

As previously described and shown in FIG. 7, each sub-column 170 includes two water-tight cells 174U, 174I containing a fixed volume of gas 106, and one gas-water adjustable cell 174L axially disposed between cells 174U, I and lower end 170*b*. However, in other embodiments, the arrangement and relative positions of the water-tight cell(s) (e.g., cells 174U, 174I) and the gas-water adjustable cell(s) (e.g., cell 174L) may be varied. For example, the gas-water adjustable cell may be axially positioned between two water-tight cells. Moreover, although sub-column 170 shown in FIG. 7 includes one gas-water adjustable cell 174L, in other embodiments, more than one gas-water adjustable cell may be included in any one or more columns or sub-columns. For example, a sub-column may include two gas-water adjustable cells proximal its lower end and two water-right cells proximal its upper end.

As previously described embodiments of platforms 100, 200 comprise columns (e.g., columns 150) made of a plurality of sub-columns (e.g., sub-columns 170). However, in other embodiments, each column of the hull may not be a multi-column formed from a plurality of sub-columns. For example, each column of the hull (e.g., each column 150 of hull 115) may comprise a single column such as that shown in FIG. 7.

In the manner described, embodiments of tension leg platform 100 and semi-submersible platform 200 are net buoyant (even with gas-water adjustable cells 174L completely flooded), and further, have no downflooding angle. As will now be described, embodiments of tension leg platform 100 and semi-submersible platform 200 are "unconditionally stable." In other words, platforms 100, 200 will not capsize regard less of the heeling angle and integrity of tendons 112 or mooring lines of mooring system 212, respectively. In particular, embodiments of platforms 100, 200 are configured such that they will return back to their vertical upright position (i.e., with deck 160 upright) when a moment induces a non-zero heeling angle. Thus, as used herein, the phrase "unconditionally stable" refers to an offshore structure (e.g., platform) that will not capsize regardless of the heeling angle and integrity of the tendons (e.g., tendons 112 associated with TLP 100) or mooring lines (e.g., mooring lines of mooring system 212).

The stability of an offshore platform may be described in terms a "righting moment" that acts on the platform in response to a heeling moment that induces a heeling angle α. In particular, the righting moment is the moment or torque that seeks to restore the platform to its vertical, upright position (i.e., no heeling angle α) after induction of a heeling angle. Conversely, the "heeling moment" is the moment or torque that seeks to tilt the platform away from its vertical, upright position, thereby inducing a heeling angle α. For example, wind acting on an offshore platform generates a heeling moment that begins to tip the platform from vertical and induce a heeling angle α. Without being limited by this or any particular theory, the heeling moment acting on an offshore platform is a function of several external forces such as wind and wave action applied to the platform, while the righting moment is a function of several platform structural characteristics such as draft, buoyancy, weight, column center-to-center spacing, etc.

Figure 10:
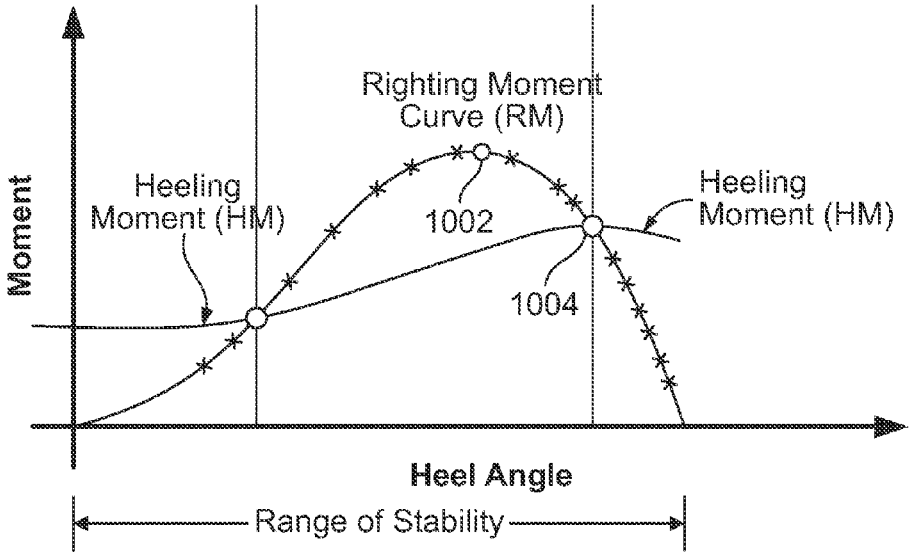
FIG. 10 is a graph illustrating the righting moment acting on a conventional offshore platform in response to a 100 knot wind load.

Calculating the heeling moments and righting moments acting on an offshore structure such as a platform, and graphing same over a range of heeling angles α to assess platform stability are well known in the art of naval architecture. Specifically, various naval architecture standards (e.g., the ABS Guide for Building and Classing Mobile Offshore Units 2008—Part 3, Chapter 3, Section 1) require generation and publication of stability graphs for various offshore structures exposed to a standard, constant 100 knot wind in intact conditions (i.e., no damage to hull compartments) and a standard, constant 50 knot wind (constant) for damaged conditions (i.e., damage to one hull compartment). Referring now to FIG. 10, an exemplary graph of stability of a conventional offshore platform subjected to a standard 100 knot wind is shown. For the conventional platform modeled in FIG. 10, the righting moment acting on the platform increases, as the heeling angle increase, to a maximum at point 1002. Thereafter, the righting moment decreases as the heeling angle increases. Beyond the second intersection of the heeling moment and righting moment at point 1004, the righting moment is less than the heeling moment, and thus, the righting moment is insufficient to restore the platform to its vertical upright position, and the platform will capsize.

Figure 11:
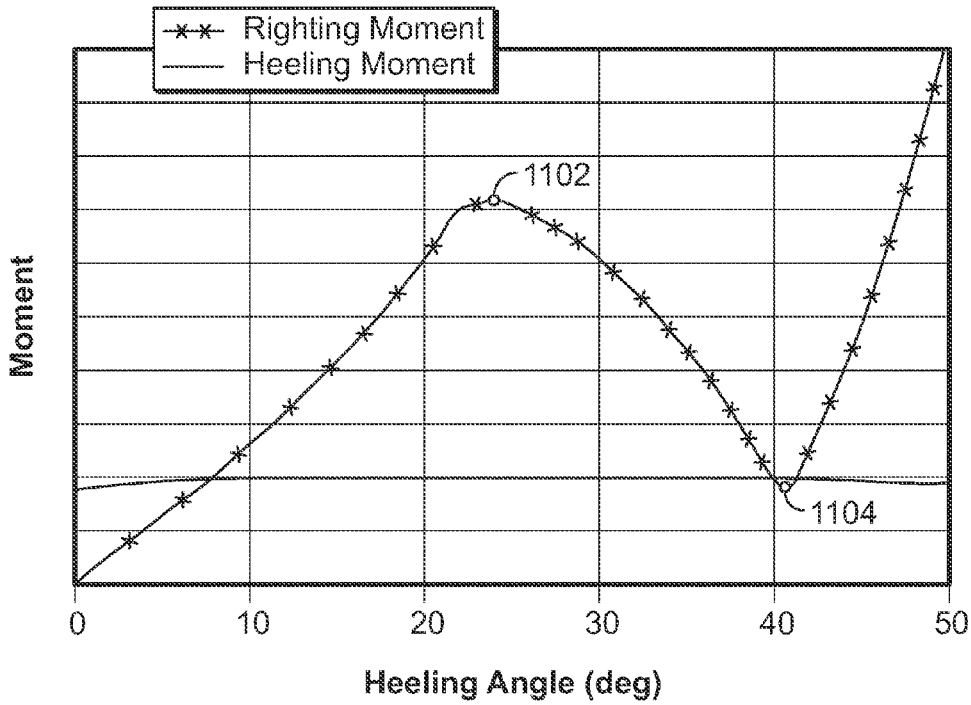
FIG. 11 is a graph illustrating the righting moment acting on an embodiment of an unconditionally stable offshore platform in accordance with the principles described herein in response to a 100 knot wind load.

Referring now to FIG. 11, a graph of stability of an exemplary embodiment of a platform in accordance with the principles described herein (e.g., platform 100, 200) subjected to a standard 100 knot wind (constant) is shown. Initially, the righting moment increases as the healing angle increases to a first peak at point 1102. Thereafter, the righting moment decreases as the heeling angle increases to a point 1104. However, contrary to the conventional platform exemplified in FIG. 10, the righting moment of acting on exemplary embodiment modeled in FIG. 10 increases as heeling angle increases beyond point 1104. Consequently, the exemplary embodiment modeled in FIG. 11 may be described as "unconditionally stable" since it will return to its upright vertical position regardless of the heeling moment and associated heeling angle induced by a standard, constant 100 knot wind.

In general, the stability of an offshore platform such as platforms 100, 200 is a function of various platform structural parameters. As is known in the art, such parameters include:

- the center-to-center spacing of the columns (e.g., columns 150) (CC);
- the water plane area of each column (e.g., column 150) ($D^2$);
- the draft of the platform (i.e., the vertical distance from keel to waterline);
- the volume of water displaced by the platform (∇);
- the freeboard (FB) (i.e., the vertical distance from the waterline to the top of the column); and
- the metacentric height (GM) (i.e., distance from the platform's center of gravity to its metacenter).

Embodiments of platforms 100, 200 described herein are configured, via adjustment of one or more of the parameters listed above, to exhibit unconditional stability as illustrated in FIG. 11. In some embodiments of platforms 100, 200, the parameters listed above are set in accordance with the following inequality:

$$\frac{\nabla}{\left(\frac{D^2\ Draft}{CC}\right)GM} < Z(FB),$$

where Z=6.

Figure 12:
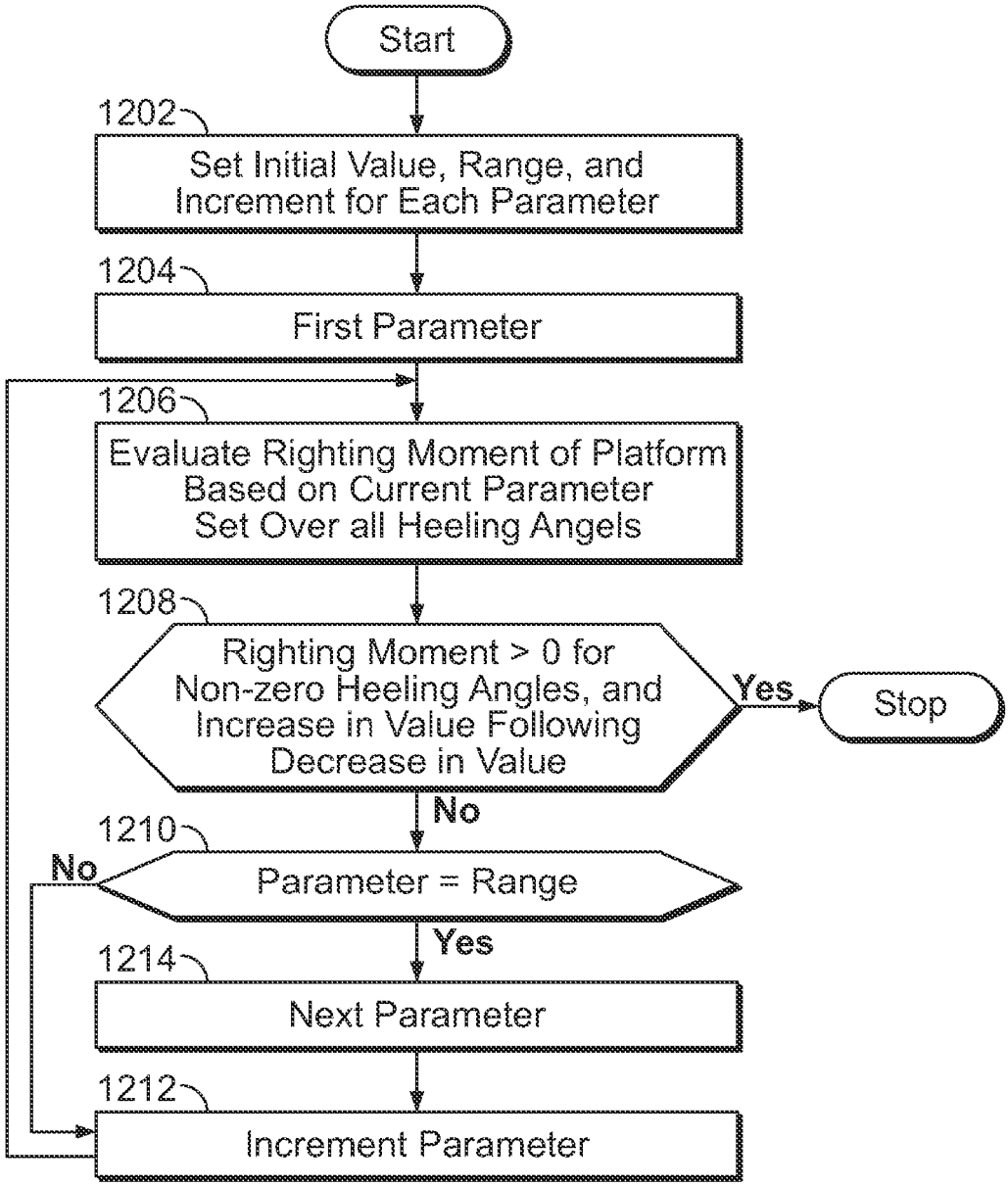
FIG. 12 is a schematic flow diagram of a method for configuring an offshore platform for unconditional stability in accordance with the principles described herein.

Referring now to FIG. 12, a schematic flow diagram of a method for configuring an offshore platform (e.g., platform 100, 200) for unconditional stability when subjected to a standard 100 knot wind is shown. Though depicted sequentially as a matter of convenience, at least some of the actions shown can be performed in a different order and/or performed in parallel. Additionally, some embodiments may perform only some of the actions shown. In some embodiments, at least some of the operations of FIG. 12 can be implemented as instructions stored in a computer readable medium and executed by a computer.

In block 1202, initial values are set for each parameter to be applied for determining platform stability. For example, initial values for GM, FB, ∇, Draft, $D^2$, and CC may be set. The initial values of the parameters may be set based on variety of design considerations including, without limitation, material cost, construction site, transport limitations, parameter values of existing platforms, desired performance characteristics, anticipated offshore environment, etc. For example, Draft may be initialized to 125 feet, center spacing to 150 feet, etc. Additionally, a range value that limits the extent of variation of the parameter, and an increment value specifying the amount the parameter is changed at each step are set for each parameter. The values of the range and increment may be determined based on considerations similar to those used to determine the initial value (e.g., a known range of acceptable values for each parameter).

In block 1204, a first of the parameters is selected for manipulation. A platform incorporating the current parameter values is evaluated for stability in block 1206. More specifically, the righting moment of the platform is evaluated over all heeling angles. Techniques for configuring a platform in accordance with the current parameter values and generating the values of the righting moment of the platform (e.g., values corresponding to the graph of FIG. 11) are well known to those skilled in art of naval architecture.

In block 1208, if the righting moment for the platform being evaluated is greater than zero for all non-zero heeling angles, and/or an increase in value (a positive slope) of the righting moment follows a decrease in value (a negative slope) of the righting moment, then the platform being evaluated is deemed to be unconditionally stable. The method may terminate after identifying a parameter set corresponding to an unconditionally stable platform, or may continue to identify additional parameter sets for other unconditionally stable platforms.

If, in block 1208, the righting moment is not greater than zero for all non-zero heeling angles, and/or if the righting moment does not increase in value following a decrease in value, then, in block 1210, the value of the parameter is checked against the parameter range. If all parameter values within the specified range have not been evaluated, then the value of the parameter is incremented in accordance with the corresponding increment value and a platform in accordance with the current parameter values is evaluated in block 1206.

If, in block 1210, it is determined that all values of the parameter within the specified range have been evaluated, then in block 1214, a next parameter is selected for manipulation, the selected parameter is incremented in block 1212, a platform evaluation continues in block 1206.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A method for designing an offshore platform, the method comprising:

(a) setting an initial value for each of a plurality of parameters that affect the stability of the offshore platform;

(b) setting an upper limit and a lower limit for each of the plurality of parameters, wherein the upper and the lower limit for each parameter defines a range for each parameter;

(c) varying a first of the plurality of parameters after (a) and (b);

(d) determining, by a computer, a first plurality of righting moments of the offshore platform for each of a first plurality of increasing heeling angles during (c), wherein the heeling angles result from a heeling moment produced by a constant 100 knot wind;

(e) determining, by the computer, whether each of the first plurality of righting moments is greater than zero for each of the first plurality of heeling angles that are non-zero during (d);

(f) determining, by the computer, whether the first plurality of righting moments increase in value after decreasing in value during (d);

(g) selecting, by the computer, values for the first plurality of parameters for which the first plurality of righting moments has an increasing set of values following a decreasing set of values through progressively increasing heeling angles; and (h) assigning, as a preferred design value for the offshore platform, a value for each of the first plurality of parameters for which the righting moments has the increasing set of values through the progressively increasing heeling angles.

2. The method of claim 1, further comprising:

(i) determining whether the first of the plurality of parameters has been varied over the range of the first of the plurality of parameters;

(j) varying a second of the plurality of parameters after (f);

(k) determining, by a computer, a second plurality of righting moments of the offshore platform for each of a second plurality of increasing heeling angles during (j), wherein the heeling angles result from a heeling moment produced by a constant 100 knot wind;

(l) determining, by the computer, whether each of the second plurality of righting moments is greater than zero for each of the second plurality of heeling angles that is non-zero during (j);

(m) determining, by the computer, whether the second plurality of righting moments increase in value after decreasing in value during (j)

(n) selecting, by the computer, values for the second plurality of parameters for which the second plurality of righting moments has an increasing set of values following a decreasing set of values through progressively increasing heeling angles; and (o) assigning, as a preferred design value for the offshore platform, a value for each of the second plurality of parameters for which the righting moments has the increasing set of values through the progressively increasing heeling angles.

3. The method of claim 2, wherein the plurality of parameters include:

a center-to-center spacing of a plurality of columns;

a water plane area of each of the plurality of columns;

a draft of the offshore platform;

a volume of water displaced by the offshore platform;

a freeboard of each of the plurality of columns; and a metacentric height of the offshore platform.

4. The method of claim 3, further comprising:

(p) selecting a value for each of the plurality of parameters in order to conform to the following inequality:

$$\frac{\nabla}{\left(\frac{D^2\ \text{Draft}}{CC}\right)GM} < Z(FB);$$

wherein $\nabla$ is the volume of water displaced by the offshore platform;

wherein $D^2$ is the water plane area of each of the plurality of columns;

wherein CC is the center-to-center spacing of the plurality of columns;

wherein GM is the metacentric height of the offshore platform;

wherein FB is freeboard of each of the plurality of columns; and wherein Z=6.

5. The method of claim 1, wherein the offshore platform comprises a buoyant hull including a plurality of columns and a plurality of elongate pontoons extending between the plurality of columns;

wherein each of the plurality of pontoons comprises a first node positioned below a lower end of one of the plurality of columns, a second node positioned below a lower end of another of the plurality of columns, and an intermediate section extending between the first node and the second node;

wherein the first node has a lower surface area $A_1$, the second node has a lower surface area $A_2$, and the intermediate section has a lower surface area $A_3$; and wherein the method further comprises (q) varying the lower surface areas $A_1$, $A_2$, and $A_3$ such that the ratio of the area $A_3$ to the sum of the area $A_1$ and the area $A_2$ is between 0.45 and 0.60.

6. The method of claim 1, wherein the offshore platform comprises a buoyant hull including a plurality of columns and a plurality of elongate pontoons extending between the plurality of columns;

wherein each of the plurality of columns has a width $W_{column}$ and wherein each of the plurality of pontoons has a minimum width $W_{minimum}$; and wherein the method further comprises:

(r) varying the width $W_{column}$ of a first column of the plurality of columns and the width $W_{minimum}$ of a first of the plurality of pontoons such that the ratio of the width $W_{minimum}$ of the first pontoon to the width $W_{column}$ of the first column is less than 1.0.

7. The method of claim 6, wherein (r) further comprises varying the width $W_{column}$ of the first column and the width $W_{minimum}$ of the first pontoon such that the ratio of the width $W_{minimum}$ of the first pontoon to the width $W_{column}$ of the first column is between 0.65 and 0.75.

* * * * *